US008207895B2

(12) United States Patent
Wong et al.

(10) Patent No.: US 8,207,895 B2
(45) Date of Patent: Jun. 26, 2012

(54) SHORTED MONOPOLE ANTENNA

(75) Inventors: Kin-Lu Wong, Tapei Hsien (TW); Shu-Chuan Chen, Tapei Hsien (TW)

(73) Assignee: Acer Inc., Taipei Hsien (TW)

( * ) Notice: Subject to any disclaimer, the term of this patent is extended or adjusted under 35 U.S.C. 154(b) by 432 days.

(21) Appl. No.: 12/605,493

(22) Filed: Oct. 26, 2009

(65) Prior Publication Data

US 2011/0018783 A1 Jan. 27, 2011

(30) Foreign Application Priority Data

Jul. 24, 2009 (TW) ..... 98125107 A

(51) Int. Cl.
*H01Q 1/12* (2006.01)

(52) U.S. Cl. ..... 343/700 MS; 343/702; 343/848

(58) Field of Classification Search ..... 343/700 MS, 343/702, 829, 846, 848
See application file for complete search history.

(56) References Cited

U.S. PATENT DOCUMENTS

| | | | | |
|---|---|---|---|---|
| 4,571,595 | A * | 2/1986 | Phillips et al. | 343/745 |
| 5,402,136 | A * | 3/1995 | Goto et al. | 343/729 |
| 6,304,219 | B1 * | 10/2001 | Rothe | 343/700 MS |
| 6,853,341 | B1 * | 2/2005 | Hellgren et al. | 343/742 |
| 7,193,565 | B2 * | 3/2007 | Caimi et al. | 343/700 MS |
| 7,425,924 | B2 * | 9/2008 | Chung et al. | 343/702 |

FOREIGN PATENT DOCUMENTS

| | | |
|---|---|---|
| TW | 254493 | 5/2006 |
| TW | 276248 | 3/2007 |

* cited by examiner

*Primary Examiner* — Tho G Phan
(74) *Attorney, Agent, or Firm* — Alan Kamrath; Kamrath IP Lawfirm, PA

(57) ABSTRACT

The present invention discloses a shorted monopole antenna comprising a radiating portion comprises a first metal portion and a second metal portion and is located on the dielectric substrate, without overlapping with the ground plane. The first metal portion comprises a coupling section formed by bending the front portion of the first metal portion into two adjacent sections with a coupling gap. A first end of the feeding portion is electrically connected to the first metal portion. A second end of the feeding portion is the antenna's feeding point. The shorting portion is disposed on the dielectric substrate, without overlapping with the ground plane. A first end of the capacitive element is electrically connected to the antenna's feeding point. A second end of the capacitive element is electrically connected to a source.

9 Claims, 4 Drawing Sheets

SHORTED MONOPOLE ANTENNA

BACKGROUND OF THE INVENTION

1. Field of the Invention

The present invention relates to a shorted monopole antenna, and more particularly, to a small-size shorted monopole antenna which is able to cover multiband operations in mobile communication devices.

2. Description of the Related Art

The fast development of wireless communication technology has created various applications and products, such as portable communication devices, which are the hottest communication products at present. In order to be light, thin, and compact and to provide multi-band operation capabilities, portable communication devices must be equipped with small antennas; therefore, various antenna miniaturization techniques have been proposed to meet requirements for portable communication devices.

Presently, a shorted monopole antenna of a portable communication device uses a multiple-resonance path or a dual-resonance path approach to achieve multi-band operations, for example, in the prior art cases such as the Taiwan patent no. I254,493, entitled "Dual-Band Inverted-F Antenna", and the Taiwan patent no. I276,248, entitled "An Internal Multi-band Antenna", which disclose shorted monopole antennas using dual resonance paths to provide dual-band or multi-band operations. However, using such a dual-resonance or multiple-resonance path approach could have limitations in further minimizing the antenna, making it difficult to meet present requirements of miniaturization of multi-band antennas.

Therefore, it is necessary to provide a shorted monopole antenna to overcome the deficiency encountered by the prior art techniques.

SUMMARY OF THE INVENTION

It is an object of the present invention to provide a shorted monopole antenna which has a small size and is able to cover multiband operations in mobile communication devices.

In order to achieve the above objects, the present invention discloses a shorted monopole antenna, which comprises: a dielectric substrate, a ground plane, a radiating portion, a feeding portion, a shorting portion, and a capacitive element. The ground plane is disposed on a portion of the dielectric substrate. The radiating portion comprises a first metal portion and a second metal portion and is located on the dielectric substrate, without overlapping with the ground plane. The first metal portion comprises a coupled section formed by bending the front portion of the first metal portion into two adjacent sections with a coupling gap, which is less than 2 mm. The length of the first metal portion is larger than one-eighth wavelength of the central frequency of the antenna's lower band. The second metal portion has a first end electrically connected to the first metal portion, and a second end being open-ended. The feeding portion is disposed on the dielectric substrate, without overlapping with the ground plane. The feeding portion has a first end electrically connected to the first metal portion, and a second end of the feeding portion being the antenna's feeding point. The shorting portion is disposed on the dielectric substrate, without overlapping with the ground plane. The shorting portion has a first end electrically connected to the first metal portion, and a second end connected to the ground plane. The capacitive element is disposed on the dielectric substrate and overlaps with the ground plane. The capacitive element has a first end electrically connected to the antenna's feeding point, and a second end electrically connected to a source.

According to an embodiment of the present invention, the first metal portion and the second metal portion can have a uniform width or a nonuniform width. The capacitive element can be a chip capacitor. The ground plane, the radiating portion, the feeding portion, and the shorting portion can be formed on a surface of the dielectric substrate by printing or etching.

Hence, the present invention provides a shorted monopole antenna with an innovative structure for various wireless communication applications.

DETAILED DESCRIPTION OF THE PREFERRED EMBODIMENT

The advantages and innovative features of the present invention will become more apparent from the following detailed description when taken in conjunction with the accompanying drawings.

Figure 1:
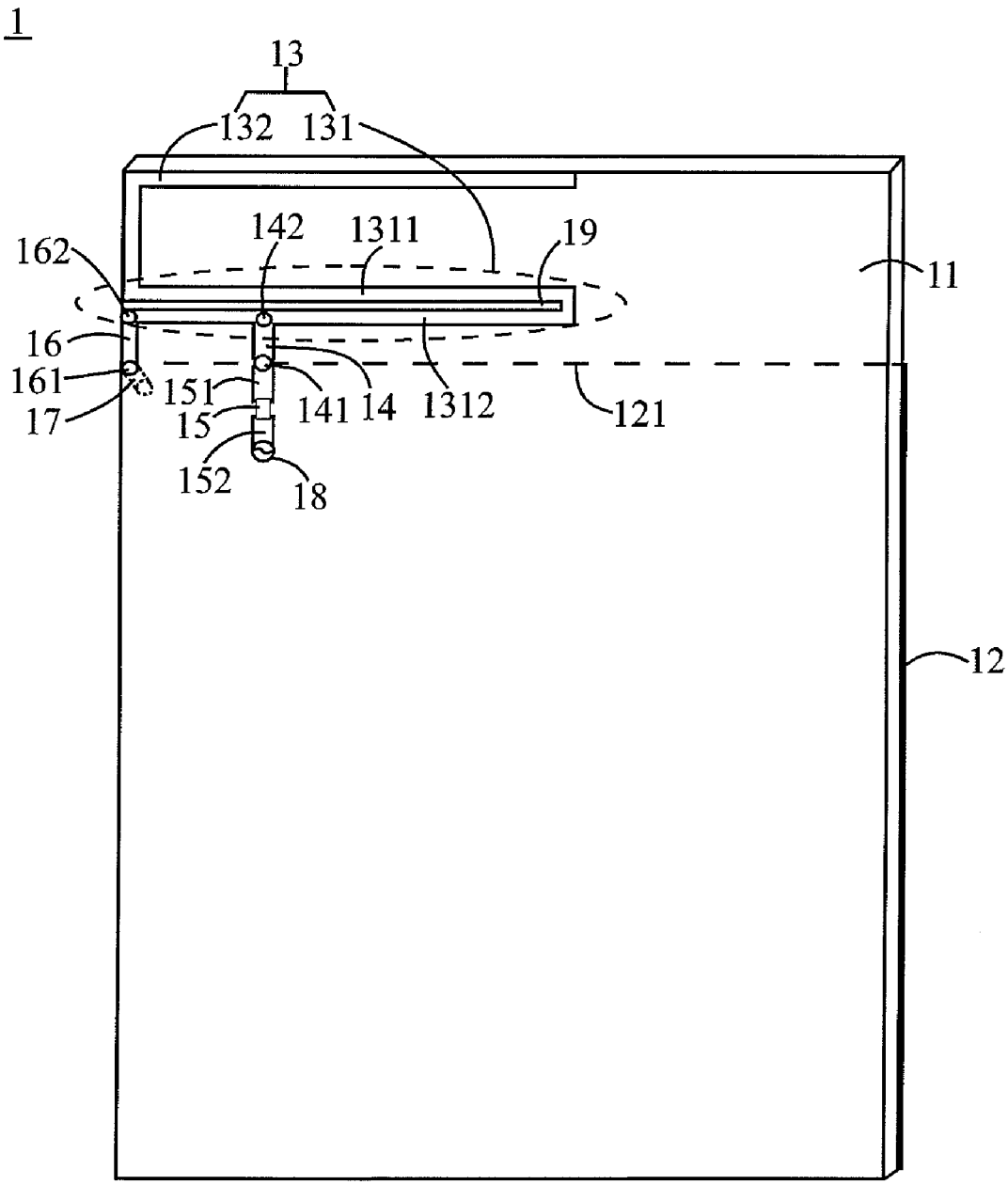
FIG. 1 illustrates a structural view of a shorted monopole antenna in a first embodiment of the present invention.

Please refer to FIG. 1 for a structural view of a shorted monopole antenna in a first embodiment of the present invention. A shorted monopole antenna 1 comprises a dielectric substrate 11, a ground plane 12, a radiating portion 13, a feeding portion 14, a shorting portion 16 and a capacitive element 15. For example, when the shorted monopole antenna 1 is applied in a portable communication device, the dielectric substrate 11 can be a system board of the portable communication device.

The ground plane 12 is on the dielectric substrate 11, and the ground plane 12 covers a portion of the surface of the dielectric substrate 11; that is, the ground plane 12 does not fully cover the dielectric substrate 11.

The radiating portion 13 is disposed on the dielectric substrate 11; the radiating portion 13 does not overlap with the ground plane 12.

In this embodiment, the ground plane 12 and the radiating portion 13 are on two opposing surfaces of the dielectric substrate 11 respectively. It is noted that the ground plane 12 and the radiating portion 13 can be on the same surface as long as the ground plane 12 does not overlap with the radiating portion 13.

The radiating portion 13 comprises a first metal portion 131 and a second metal portion 132. The first metal portion 131 comprises a coupling section formed by bending the front portion of the first metal portion 131 into two adjacent coupling metal portions 1311, 1312 with a coupling gap 19, wherein the coupling gap must be less than 2 mm to generate enough capacitive coupling effect.

It is an object of the first metal portion 131 to form two adjacent coupling metal portions to use two resonant modes to form a higher frequency band for the shorted monopole antenna 1 so as to cover the GSM1800/1900/UMTS operation. When the width of the coupling gap 19 decreases, it is easier to use the resonant modes to form a higher frequency band for the shorted monopole antenna 1.

Besides, a total length of the first metal portion 131 should be larger than one-eight of the wavelength of the central frequency of the antenna's lower band. In this embodiment, the coupling gap 19 has a uniform width. It is noted that the coupling gap 19 doesn't have to have a uniform width.

One end of the second metal portion 132 is electrically connected to the first metal portion 131, and the other end is open-ended. The total length of the second metal portion 132 and the first metal portion 131 can determine the lowest frequency of the resonant modes. In this embodiment, the second metal portion 132 is substantially of an L shape, and each one of the first metal portion 131 and the second metal portion 132 has a uniform width.

The feeding portion 14 is disposed on the dielectric substrate 11 and is on the same surface as the radiating portion 13; the feeding portion 14 does not overlap with the ground plane 12; one end 142 of the feeding portion 14 is electrically connected to the coupling metal portion 1312 of the first metal portion 131, and the other end is an antenna feeding point 141.

The shorting portion 16 is on the dielectric substrate 11 and is on the same surface as the radiating portion 13; the shorting portion 16 does not overlap with the ground plane 12; one end 162 of the shorting portion 16 is electrically connected to a coupling metal portion 1312 of the first metal portion 131, and the other end is a shorting point 161 which is electrically connected to the ground plane 12 through a via-hole 17.

The radiating portion 13, the feeding portion 14, and the shorting portion 16 can be formed on the dielectric substrate 11 by printing or etching. The capacitive element 15 is an external circuit component and is disposed on the dielectric substrate 11; the capacitive element 15 and the radiating portion 13 are on the same surface. The capacitive element 15 overlaps with the ground plane 12; one end of the capacitive element 15 is electrically connected to the antenna feeding point 141 through the metal connecting line 151, and the other end is electrically connected to the source 18 through the metal connecting line 152. In this embodiment, the capacitive element 15 is a chip capacitor.

In this embodiment, the ground plane 12 is on one surface of the dielectric substrate 11, and the radiating portion 13, the feeding portion 14, the shorting portion 16 and the capacitive element 15 are all on another surface of the dielectric substrate 11. However, it is noted that the ground plane 12, the radiating portion 13, the feeding portion 14, the shorting portion 16, and the capacitive element 15 can be on the same surface of the dielectric substrate 11.

Figure 2:
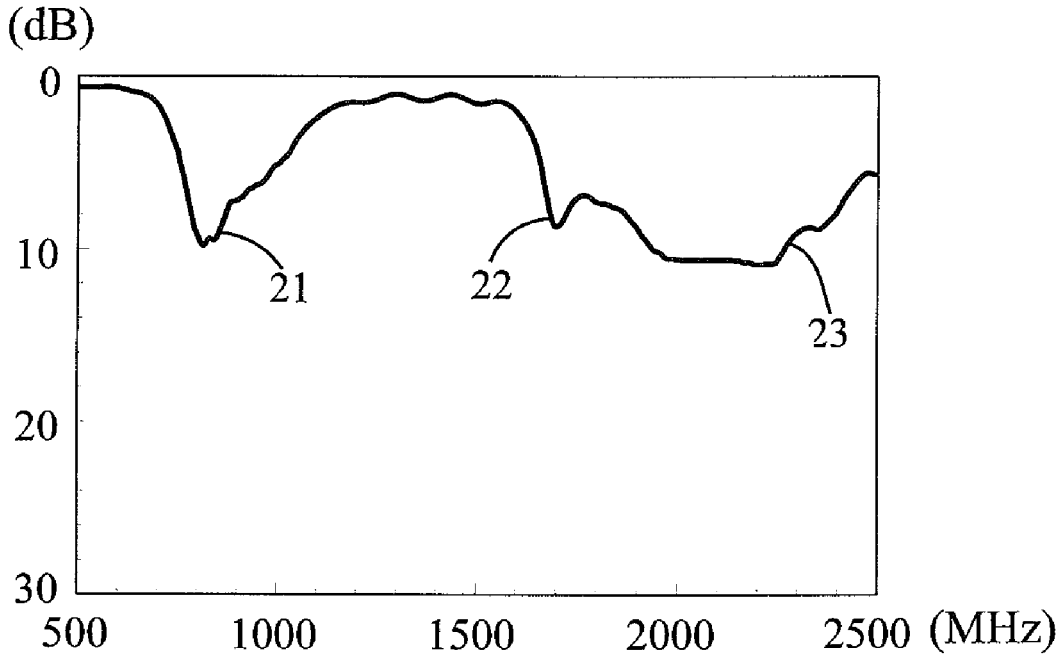
FIG. 2 illustrates a diagram of a measured return loss of the shorted monopole antenna in the first embodiment of the present invention.

Please refer to FIG. 2 for a diagram of a measured return loss graph of the shorted monopole antenna in the first embodiment of the present invention. In the first embodiment, the following parameters are chosen to conduct the test: the dielectric substrate 11 is about 110 mm long and 60 mm wide; the ground plane 12 is about 100 mm long and 60 mm wide; the first metal portion 131 is 73 mm long and 1 mm wide, and comprises a coupling gap 19 of about 0.8 mm; the second metal portion 132 is 40 mm long and 1 mm wide; the feeding portion 14 is about 2 mm long and 1.5 mm wide; the shorting portion 16 is 2 mm long and 1 mm wide; the capacitive element 15 is implemented by a chip capacitor having a capacitance value of about 3.3 pF.

From the experimental results, with the definition of 6-dB return loss, the first (lowest) resonant mode 21 is able to cover the GSM850/900 operation; and the second and the third resonant modes 22, 23 are formed into a wider band to cover the GSM1800/1900 and UMTS operation. Therefore, the shorted monopole antenna can cover the GSM850/900/1800/1900/UMTS operation to meet the requirements of modern multiband communication.

Figure 3:
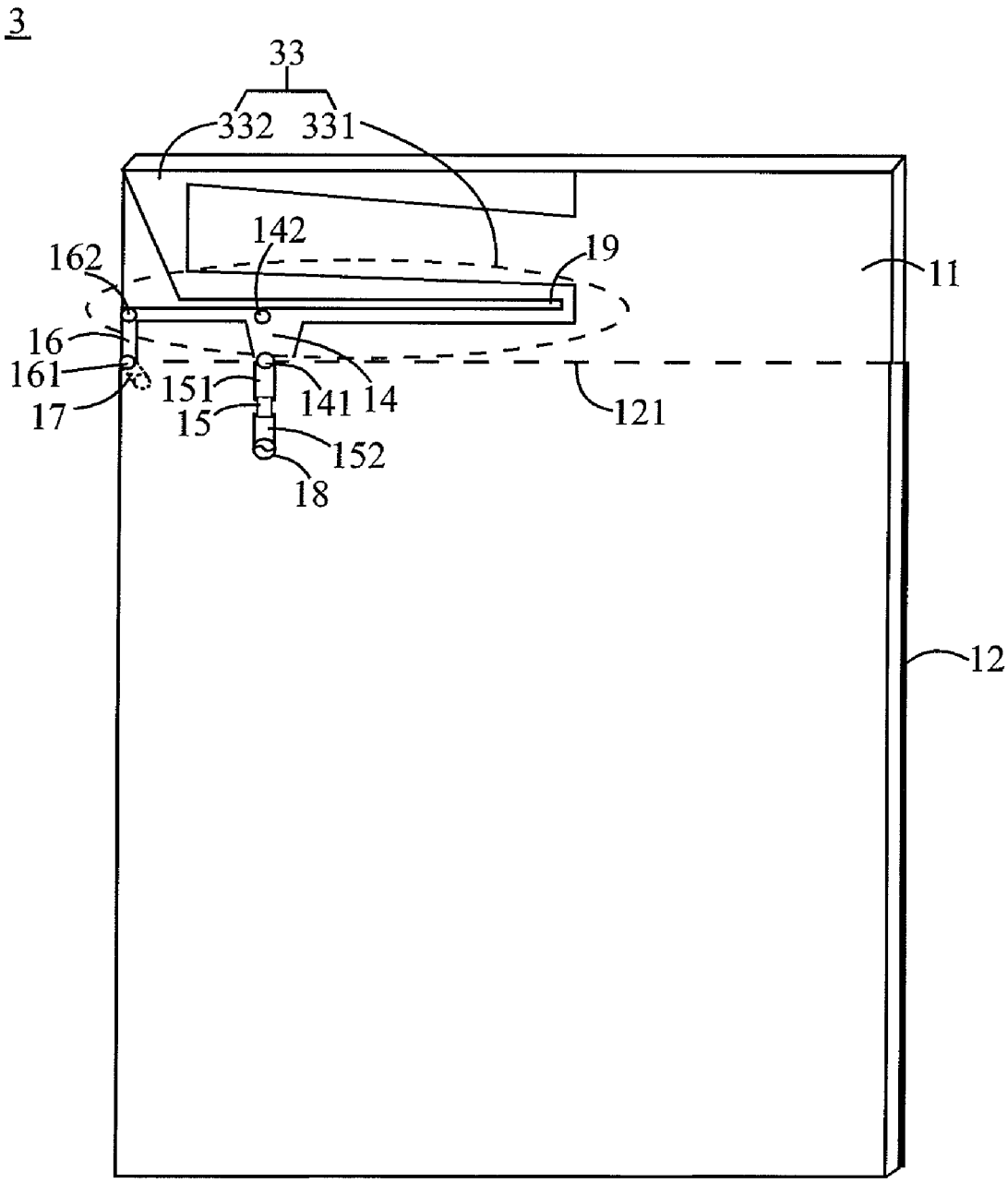
FIG. 3 illustrates a structural view of a shorted monopole antenna in a second embodiment of the present invention.

FIG. 3 illustrates a structural view of a shorted monopole antenna in a second embodiment of the present invention. A shorted monopole antenna 3 comprises the dielectric substrate 11, the ground plane 12, the radiating portion 33, the feeding portion 14, the shorting portion 16, and the capacitive element 15. The radiating portion 33 comprises a first metal portion 331 and a second metal portion 332. The difference between the second embodiment and the first embodiment is that, in the second embodiment, the first metal portion 331 and the second metal portion 332 can have gradually changed widths respectively to form structures having nonuniform widths so as to achieve the object of better impedance matching for the antenna, thereby enhancing the flexibility and the degree of freedom in designing the shorted monopole antenna by tuning the frequency of each resonant mode. Furthermore, the feeding portion 14 can also have a gradually changed width to form a structure having a nonuniform width or a wider width to smoothly provide the feeding current, thereby achieving better impedance matching for the antenna.

Figure 4:
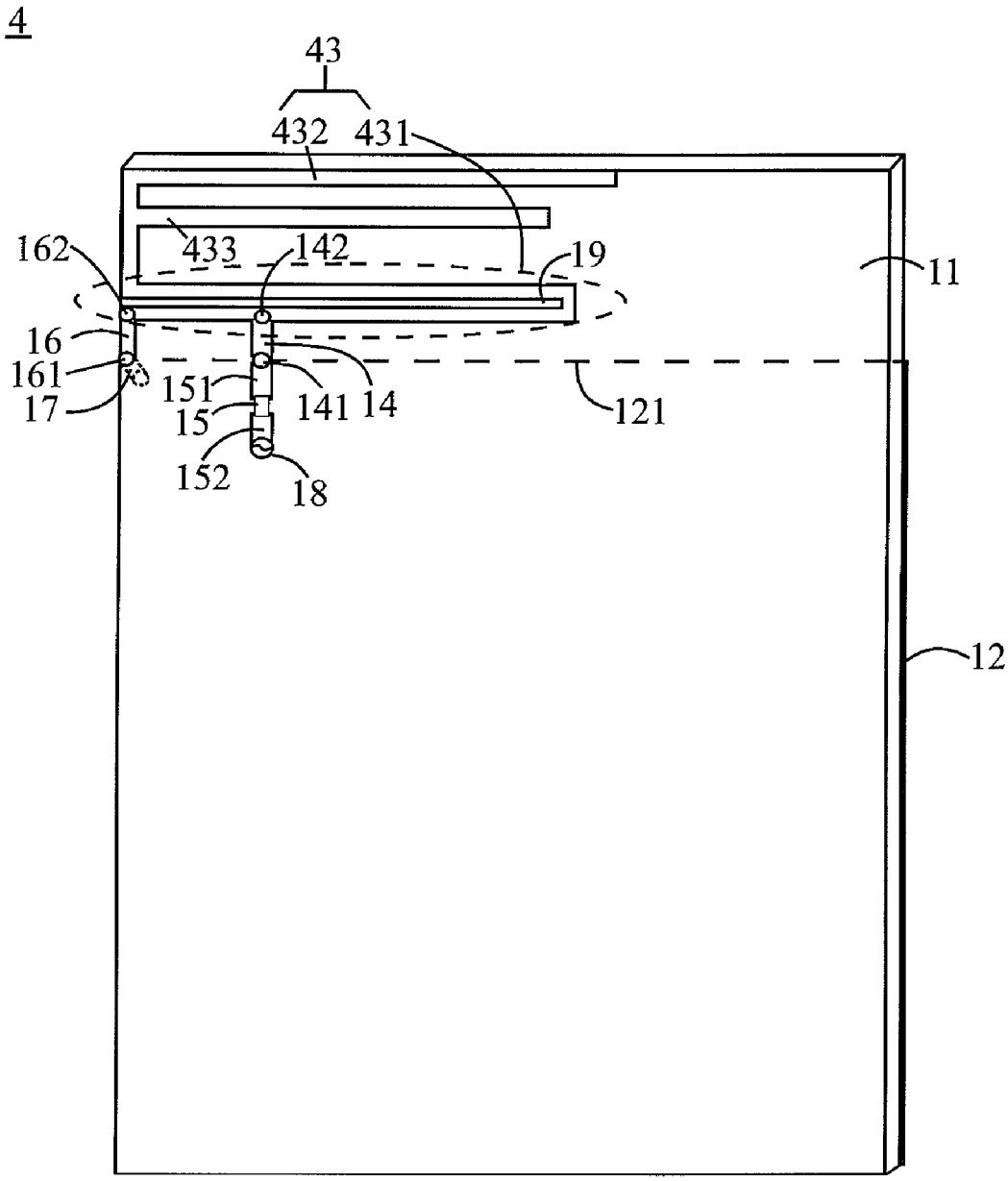
FIG. 4 illustrates a structural view of a shorted monopole antenna in a third embodiment of the present invention.

FIG. 4 illustrates a structural view of a shorted monopole antenna in a third embodiment of the present invention. A shorted monopole antenna 4 comprises the dielectric substrate 11, the ground plane 12, the radiating portion 43, the feeding portion 14, the shorting portion 16, and the capacitive element 15. The radiating portion 43 also comprises a first metal portion 431 and a second metal portion 432; the second metal portion 432 further comprises a branch 433. In this embodiment, all the elements are the same as in the first embodiment, except for the addition of the branch 433 of the second metal portion 432. In the third embodiment, the additional branch 433 can provide an additional resonant path to cover additional frequency bands, particularly higher frequency bands.

Hence, the present invention discloses a shorted monopole antenna using an external capacitive element to compensate for the large input inductance seen at the first resonant mode of the antenna to cover the GSM850/900 operation; moreover, by setting the length of the coupling metal portion to be larger than one-eight of the wavelength of the central frequency of the antenna's first resonant mode, the length of the coupling metal portion can cover the nulls of the excited surface currents (where the corresponding electric field is at its maximum) of the second and the third resonant modes; under this condition, the coupling metal portion can introduce additional capacitance to the third resonant mode to shift the third resonant mode to lower frequencies and can also improve the impedance matching of the second resonant mode, such that the second and the third resonant modes form into a wider frequency band to cover the GSM1800/1900/UMTS operation. Therefore, the shorted monopole antenna in the present invention can use one single resonant path to cover the GSM850/900/1800/1900/UMTS operation, since the antenna can operate in multiple frequency bands and has a small size; it can be applied in portable communication devices.

It is noted that the above-mentioned embodiments are only for illustration. It is intended that the present invention cover modifications and variations of this invention provided they fall within the scope of the following claims and their equivalents. Therefore, it will be apparent to those skilled in the art that various modifications and variations can be made to the structure of the present invention without departing from the scope or spirit of the invention.

What is claimed is:

1. A shorted monopole antenna comprising:

a dielectric substrate;

a ground plane disposed on a portion of the dielectric substrate;

a radiating portion disposed on the dielectric substrate, wherein the radiating portion does not overlap with the ground plane, and the radiating portion comprises:

a first metal portion bent to form two adjacent coupling metal portions with a coupling gap, wherein the coupling gap is less than 2 mm, and a length of the first metal portion is larger than one-eighth wavelength of a central frequency of the antenna's lower band; and a second metal portion, the second metal portion having a first end electrically connected to the first metal portion, and a second end being open-ended;

a feeding portion disposed on the dielectric substrate, without overlapping with the ground plane, the feeding portion having a first end electrically connected to the first metal portion, and a second end being an antenna feeding point;

a shorting portion disposed on the dielectric substrate, wherein the shorting portion does not overlap with the ground plane, the shorting portion has a first end electrically connected to the first metal portion, and a second end electrically connected to the ground plane; and a capacitive element disposed on the dielectric substrate, the capacitive element overlapping with the ground plane and having a first end electrically connected to the antenna feeding point, and a second end electrically connected to a source.

2. The shorted monopole antenna as claimed in claim 1, wherein the dielectric substrate is a system board of a portable communication device.

3. The shorted monopole antenna as claimed in claim 1, wherein the radiating portion, the feeding portion, and the shorting portion are formed on the dielectric substrate by printing or etching.

4. The shorted monopole antenna as claimed in claim 1, wherein the capacitive element is a chip capacitor.

5. The shorted monopole antenna as claimed in claim 1, wherein the first metal portion and second metal portion have a uniform width or a nonuniform width.

6. The shorted monopole antenna as claimed in claim 1, wherein the second metal portion further comprises at least one branch.

7. The shorted monopole antenna as claimed in claim 1, wherein the feeding portion has a uniform width or a nonuniform width.

8. The shorted monopole antenna as claimed in claim 1, wherein the ground plane is on a plane of the dielectric substrate; the radiating portion, the feeding portion, the shorting portion and the capacitive element are on another plane of the dielectric substrate.

9. The shorted monopole antenna as claimed in claim 1, wherein the ground plane, the radiating portion, the feeding portion, the shorting portion, and the capacitive element are on a plane of the dielectric substrate.

* * * * *